US008997668B1

(12) United States Patent
Weiner

(10) Patent No.: US 8,997,668 B1
(45) Date of Patent: Apr. 7, 2015

(54) OVERTUFTING STATION

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 0 days.

(21) Appl. No.: 14/149,125

(22) Filed: Jan. 7, 2014

Related U.S. Application Data

(60) Provisional application No. 61/761,482, filed on Feb. 6, 2013, provisional application No. 61/762,458, filed on Feb. 8, 2013, provisional application No. 61/766,968, filed on Feb. 20, 2013, provisional application No. 61/833,560, filed on Jun. 11, 2013.

(51) Int. Cl.
*D05C 15/30* (2006.01)
*D05B 19/14* (2006.01)
*D05C 15/34* (2006.01)

(52) U.S. Cl.
CPC ..... *D05C 15/30* (2013.01); *D05B 19/14* (2013.01)

(58) Field of Classification Search
CPC ..... D05C 15/00; D05C 15/08; D05C 15/10; D05C 15/12; D05C 15/14; D05C 15/16; D05C 15/20; D05C 15/26; D05C 15/30; D05C 15/34; D04H 11/08; D03D 27/00; D05B 19/14
See application file for complete search history.

(56) References Cited

U.S. PATENT DOCUMENTS

| | | | | |
|---|---|---|---|---|
| 4,109,593 | A * | 8/1978 | Barnes et al. | 112/80.08 |
| 4,693,190 | A * | 9/1987 | Slattery | 112/80.3 |
| 4,790,252 | A * | 12/1988 | Bardsley | 112/80.4 |
| 4,820,566 | A * | 4/1989 | Heine et al. | 428/88 |
| 5,503,092 | A * | 4/1996 | Aubourg et al. | 112/80.23 |
| 6,260,493 | B1 * | 7/2001 | Dean | 112/80.04 |
| 7,218,987 | B2 * | 5/2007 | Mile et al. | 700/137 |
| 7,814,850 | B2 * | 10/2010 | Bearden | 112/80.4 |
| 8,225,727 | B2 * | 7/2012 | Wilson et al. | 112/80.05 |
| 2014/0272260 | A1 * | 9/2014 | Weiner et al. | 428/88 |

* cited by examiner

*Primary Examiner* — Ismael Izaguirre
(74) *Attorney, Agent, or Firm* — Stephen J. Stark

(57) ABSTRACT

An overtufting machine/method provides additional yarn per area in an area of design than in areas lacking the overtufted design. Specifically, for many embodiments, a carpet is first tufted, and then run past an overtufting station which preferably moves in a lateral direction relative to the direction of feed to direct at least one needle through the carpet in at least one selectable height option. Rails are preferably used to shuttle the needle supported by a head on at least one carriage to shuttle along the rail(s).

20 Claims, 4 Drawing Sheets

OVERTUFTING STATION

CLAIM OF PRIORITY

This application claims the benefit of U.S. Provisional Patent Application Nos. 61/761,482 filed Feb. 6, 2013, 61/762,458 filed Feb. 8, 2013, 61/766,968 filed Feb. 20, 2013, and 61/833,560 filed Jun. 11, 2013, all of which are incorporated by reference in their entirety.

FIELD OF THE INVENTION

The present invention relates to a tufting operation and particularly a tufting operations such as tufting through a pre-tufted carpet to provide a design feature therethrough, and in many embodiments the area of the design feature will have a higher stitch count than portions not having the design feature, and still other embodiments envision cross-tufting, i.e., tufting in a lateral direction relative to the direction of feed, or possibly simultaneously with a direction of feed for some embodiments.

BACKGROUND OF THE INVENTION

Patents such as U.S. Pat. Nos. 7,218,987 and 8,225,727 allow creative images to be tufted into carpet backing. Other devices similar to those shown in U.S. Pat. Nos. 7,814,850 and 7,478,605 are also known for such use. While these are all excellent devices for slow speed operation, the applicant desires to rely on a machine and methodology which will improve his prior art techniques and machines.

Also, mending guns have been available to the carpet industry to add stitches of carpet where missed during making carpet. These guns typically have a single needle and some may have yarn feed systems to allow for multiple pile heights such as shown and described in U.S. Pat. No. 6,260,493, incorporated herein by reference. Other mending guns may have a cutting attachment to be able to cut inserted yarn such as shown and described in U.S. Pat. No. 3,645,249 incorporated herein by reference. However, these guns are designed to be used to tuft through backing (and not the pre-tufted carpet) to fill in where tufting machines have not already introduced yarn.

SUMMARY OF THE INVENTION

It is a present object of many embodiments of the present invention to provide an tufting machine and/or methodology, particularly one suited to overtuft through a pretufted carpet with design elements that are believed to be somewhat novel in approach.

Specifically, a roll which is preferably could be a pretufted roll of carpet, but could also be a roll of yet-to-be tufted backing for at least a few embodiments, may be fed through the tufting machine such as from a supply roll to a finished roll. Some embodiments can provide prior art tufting through backing and then a second station for overtufting. A presently preferred embodiment of the present invention provides the input roll to a tufting machine which tufts through a roll of pre-tufted carpet in many embodiments ("carpet material"). Feed and/or processed rolls may be servo and/or otherwise controlled to feed in the direction of feed from the input roll to the processed or finished roll in a direction of tuft. Other embodiments may operate on a plotter style system with or without rolls. And still other systems may not use rolls at all.

Intermediate the input roll and the processed roll may preferably at least one tufting station having a head supported by a frame. The head may be comprised of a plurality of needles, possibly 24 or other number, whereby the needles may engage the carpet material as it passes from the input roll to the processed roll. The tufting head may be elevationally adjustable relative to the carpet material when tufting and/or at least some, if not any of individual needles, may be elevationally positionable to provide for pile height adjustment, possibly on the fly. Pile height may also be adjusted/adjustable with a yarn feeder mechanism or otherwise to the needle, such as can be found with needle mending gun technology. Cutters may be provided to cut the yarn from individual needs. Also the needles may be arranged in an array other than 1×24, such as 6×4 or any other array. Some of the needles are preferably aligned linearly with a direction of feed for many embodiments. Other needles may be aligned in the lateral direction (perpendicular to the direction of feed). Still other embodiments may provide an array which is not aligned with one or both of the direction of feed or the lateral direction.

A second tufting station may be located before the first station (i.e., closer to the input roll). The second tufting station may tuft backing to provide pre-tufted carpet to the first station for at least some embodiments.

Furthermore, the tufting head may preferably be laterally moveable relative to the carpet material and/or frame so that cross tufting can be accomplished as well as possibly tufting into or away from a direction feed from the input to the processed rolls, or even angularly tufted such as diagonal, curved or other configurations. The carpet may also be moveable relative to tufting heads for some embodiments. Bands of material may be tufted laterally (cross tufting) or even obliquely (at an acute angle relative to lateral tufting) for some embodiments. It can be quickly seen that with x-y capability, angles, curves, or virtually any tufting pattern could be established. Furthermore, in some embodiments, the individual needles, whether individually and/or collectively may be adjustable in width and/or elevation amongst themselves on the tufting head attributing to additional effect. In some embodiments needle spacing may be automatedly controllable so that the at least assisting in spacing between adjacent needles could be adjusted possibly even on the fly. Elevational adjustment could also be adjustable, as discussed above.

One or more tufting head(s) may also be moveable into the direction of the feed or away from the direction of the feed such as by having rollers on a carriage and/or frame portion which may also be controlled by servo motors and/or other mechanisms by their adjustment mechanisms. Although cooperating hook and/or knife feet(s) may cooperate with head(s) for at least some embodiments, presently preferred embodiments may operate more like a mending gun for each needle or otherwise and can produce multiple pile heights without a cooperating foot with hook and/or knife feet. Furthermore, as would be understood by those of ordinary skill in the art, not only is x-y and z adjustability provided for one or more needles within the tufting head, individual needles may also be provided with various adjustability in accordance with the sophistication of the computer program and/or equipment controlling the tufting operation. Furthermore, multiple heads may be used in parallel or may be separately controllable on the tufting machine in various embodiments. While operation like a tufting machine can occur, the applicant ran a mending gun across a twelve foot section of pre-tufted carpet in about 90 seconds to show proof of concept that the mending gun could drive the needle consistently through pre-tufted carpet. Plotter style constructions could also be employed with this technology as well as other machines that could support one or more heads overtufting designs through pre-tufted carpet.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
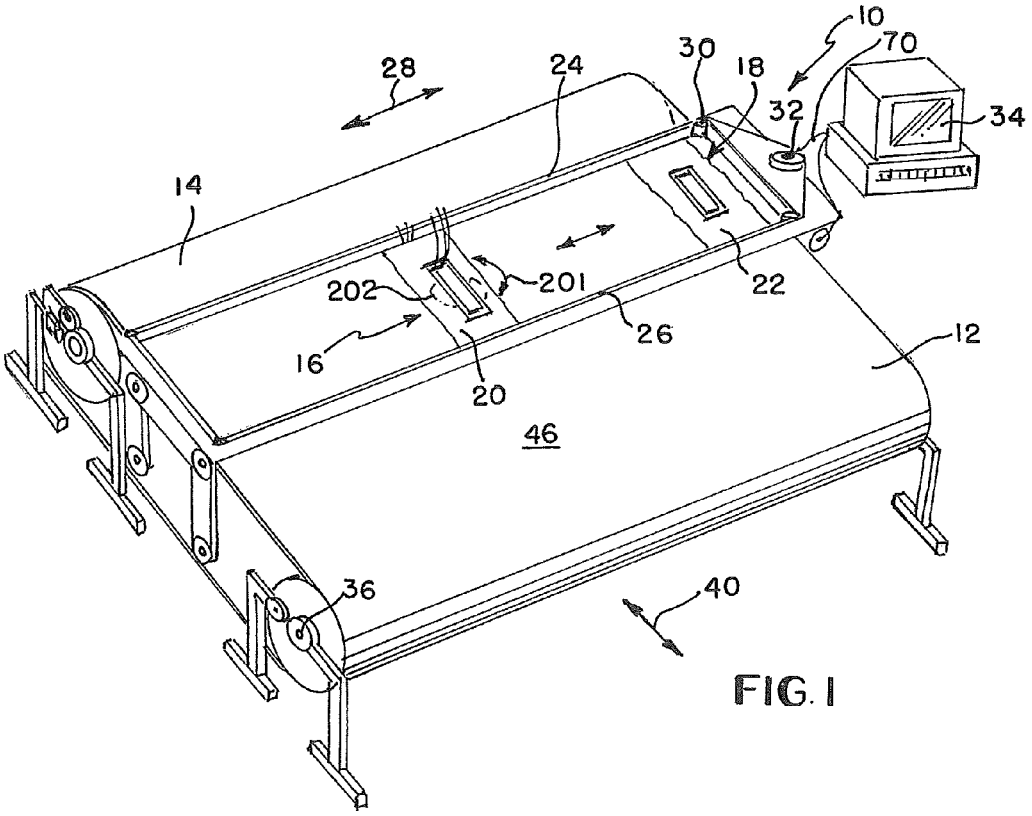
FIG. 1 is a perspective view of a tufting machine in the presently preferred embodiment of the present invention.

FIG. 1 shows a top perspective view of a tufting machine 10 having rolls 12,14. The input roll 14 is preferably pre-tufted carpet but could also be just backing for at least some embodiments. Roll 12 is preferably a treated or processed roll having passed through the treatment of one or more tufting heads 16,18 and/or others in the tufting machine 10.

Roll 12 has been tufted in accordance with common tufting techniques as are widely known in the art. Specifically, a pre-determined number of stitches are preferably tufted per distance, such as per inch like 10 or 12. Furthermore the gage (or spacing between) between adjacent needles is normally determined by the tufting machine utilized. Accordingly for a set stitch count per inch, a relatively uniform pattern can be achieved, such as 10×10 per inch, 10×12 per inch, etc.

Some embodiments do not want or specify uniformity at the upper surface. Four yarns might be directed through one needle, while two yarns might be directed through adjacent needles to provide a couroroy type pattern of loops, possibly either with, or without varying pile height.

One or more tufting head(s) 16,18 may be mounted on one or more carriages 20,22 on one or more rails 24,26 or other appropriate structure for lateral movement in the directions 28 shown in FIG. 1. Rolls 12,14 could shift in the lateral directions 28 for some embodiments to impart motion of the carpet material 46 relative to one or more heads 16,18. Still further embodiments could move both heads 16,18 and carpet material 46 in the lateral direction 28. This can be accomplished by one or more chains, belts, motors, screws and/or other driver 30 such as driver 30 being driven by servo motor 32 and/or other mechanism in the lateral direction 28 as would be understood by those of ordinary skill in the art. Multiple carriages 20,22 may be used and may be driven by one or more drivers 30 either simultaneously or independently relative to one another as would be understood by those of ordinary skill in the art.

Rolls 12,14 could also be a portion of a tufting machine intermediate to or in conjunction with one or more carriages 20,22 could be directed. Of course, for even more custom looking work, one or more hand held heads 16,18 could be employed.

Computer 34 could preferably control not only lateral movement of the heads 16,18, for some embodiments, but also other movements which will be described below. Movements of the finished roll 12 relative to input roll 14 can be controlled by servo motors 36,38 and/or other mechanism so that movement into or away from the direction of feed 40 may be accomplished such as controlled by computer 34 or other device. The reverse direction of feed may also be accomplished with one or more servo motors 36,38 and/or other mechanism as would also be understood by those of ordinary skill in the art. The lateral direction 28 is perpendicular to the direction of feed 40. Other embodiments may use a plotter style construction and/or other constructions possibly without rolls 12,14. Some embodiments may not have computers 34 moving one or more heads 16,18. Instead, heads 16,18, preferably, but not always mounted on carriages 20,22, could be pushed by an operator across the input roll 14, or in a desired pattern relative to the input roll 14.

Figure 6:
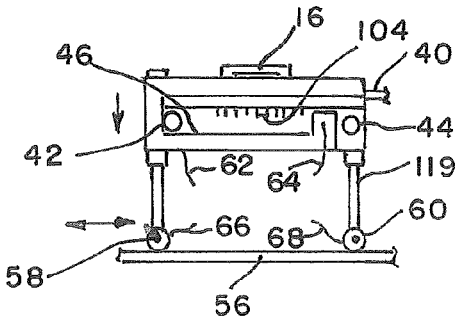
FIG. 6 is a side plan view of a portion of the tufting machine showing a hook and/or knife system which may be utilized in at least some embodiments.
Figure 7:
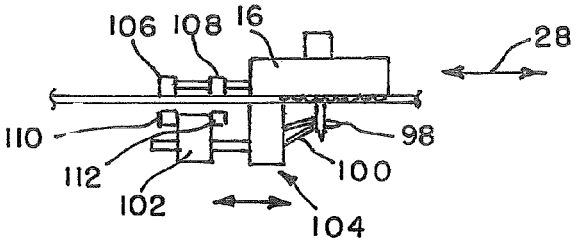
FIG. 7 is a detailed rear plan view of the hook and/or knife system shown in FIG. 6 which with an alignment system may.

Meanwhile, with reference to FIG. 6 and/or others, one of ordinary skill in the art will see that the tufting heads 16,18 may be elevationally and possibly controllably adjustable relative to a frame portion 19 and/or carpet material 46 such as with one or more servo motors 42,44 or other mechanism so as to direct the depth of tuft through the carpet material 46 whether it be yet-to-be tufted backing or tufted carpet through backing which is used in many of the preferred embodiments. Some embodiments may be able to move head(s) 16,18 relative to carriages 20,22 in other ways such as by rotation 201 about bearing 202 or otherwise; possibly on the fly.

However, many embodiments will move needles as will be described below with reference to FIGS. 8-10. Like moving the lateral direction 28 of the heads 16,18 elevation would be changed on the fly so can the elevation of the needles relative the material 46 such as by servo motors 42,44 to move the heads 16,18 and/or elevation of the material 46 as desired using computer 34 or other device. Alternative embodiment may employ different mechanisms such as servo motor 50 shown in FIG. 4 to move the heads collectively and/or individually 16,18 relative to the carriage 20 and 22. Still further embodiments may be known to change elevation of the tuft of the carpet material 46 or other ways such as with technology similar to that of U.S. Pat. No. 6,260,493 or other device. Yarn feed systems may also be used to change tuft height in still other embodiments.

It is also possible that tufting head 16,18 may be moved to proceed in or away from the direction of feed such as by moving along track 56 as may be directed by hand, one or more servo motors 58,60 or other device as shown in FIG. 6, or otherwise, and is controlled by computer 34 or otherwise. Computer 34 may also control elevation of needles 52,54 and/or tufting head(s) 16,18. Servo motors 42,44 may also be controlled by the computer 34. Communicators 62,64,66,68, 70,72 etc. may provide links between computer 34 and many of the servo motors 42,44. One or more yarns may be directed through needles 52,54 during the process. Yarns fed through each of the needles 52,54, particularly if multiple yarns are simultaneously directed through a specific needle such as 52 may or may not be cabled or otherwise wound either loosely or tightly around one another.

Figure 2:
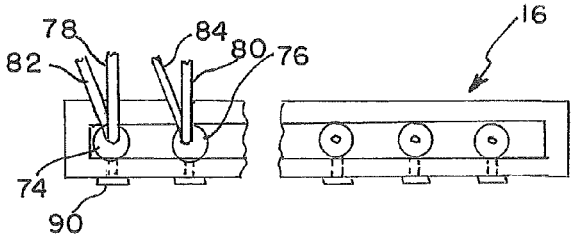
FIG. 2 is a top plan view of the presently preferred embodiment of the tufting head as shown in FIG. 1.
Figure 3:
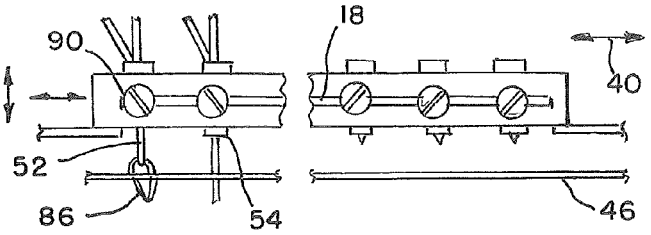
FIG. 3 is a side plan view of the tufting head shown in FIGS. 1-2.
Figure 4:
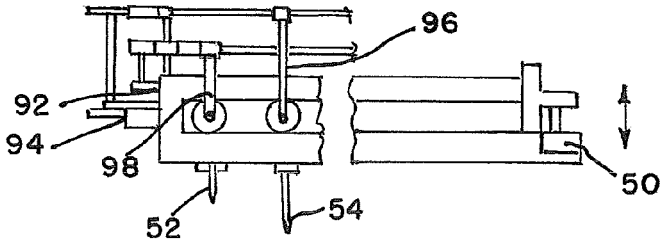
FIG. 4 is an alternative side plan view of the preferred embodiment of a tufting head of FIGS. 1-2 showing the ability to automatedly adjust the spacing between adjacent needles.
Figure 5:
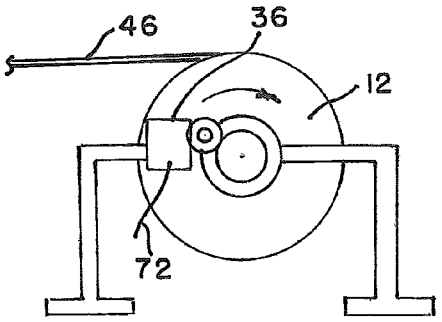
FIG. 5 is a detailed side view of the processed roll.

As can be seen in FIG. 2, each of the needle assemblies 74,76 shown in FIGS. 3 and 4 or others may be provided with a yarn inlet 78,80 which is preferably a tube directing yarn to needles 52,54. Air inlet 82,84 provides a mechanism to advance yarn through the yarn inlet 78,80 as desired so that tufts such as loop 86 shown in FIG. 3 can be created through extension as shown by 54 and retraction as shown as 52 as controlled by computer 34 or other device. Other operational systems may utilize air differently or not at all. This can be somewhat similar to mending gun operation such as shown in FIG. 12 which shows a needle assembly provided as a gun 100 having needle 102 which could be connected to a carriage or other structure for movement in at least one of directions 40,28 unless the carpet is moved relative to the gun 300 which could occur for at least some embodiments.

Figure 12:
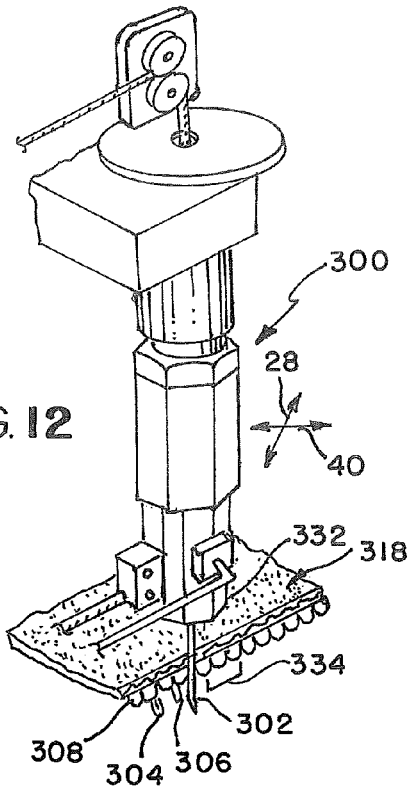
FIG. 12 is a cutaway side perspective view of a needle gun providing a pattern of overtufted carpet providing at least two pile heights as part of a design.

Needles 302 may be able to deliver multiple pile height such as high loops 304 or low loops 306 or even loops at or below the level of pre-tufted loops 308 as seen in FIG. 12. Still other elevations and/or more elevations may be achieved with various embodiments. Patterns such as design 310 can be seen in FIG. 13. Notice that with pretufted carpet, pretufted loops form a pattern or design. Although a single pile height design is shown, more complex designs could be provided as pretufted carpet. With the desired yarn spacing from the pretufted loops 10×6 shown, the methodology of this patent is employed to introduce a pattern, namely with loops 304,306, 312,314 introduced into the pre-existing pretufted carpet to effectively add additional loops within the pattern of pretufted carpet 318. The denser the design introduced by this methodology, the more tufts per area occur in that areas as opposed to similar portions that do not add design elements by this technology. Although loops 304,306,312 and 314 are shown as black compared to white for pre-existing loops 308, one of ordinary skill in the art will understand that any color combinations or even similar colors can be used for various designs. Various elevations can also be produced for loops 304,306,312 and 314 for at least some embodiments.

Adjacent needle assemblies 74,76 can be moved or adjusted along track 88 to desired locations such as by ½ inch locations and then secured in place such as with locks 90, etc. Alternatively, needle positions may be moved on the fly for some embodiments such as with servo motors 92,94 or other devices moving locators 96,98 in needle assemblies 74,76 as would be understood by one of ordinary skill in the art with reference to FIG. 4 using computer 34 or other device. Other ways of moving the needle assemblies 74,76 on the fly or otherwise could also be employed with other embodiments. Similar technology may be used to carriage 22 relative to carriage 20 for at least some embodiments. Other mechanisms may be used with other embodiments.

As may be understood from FIGS. 3 and 4, the bottom of the head 16,18 provides extension of needles 52,54 etc. like a rake for at least one embodiment depending on the spacing of the adjacent needle assemblies 74,76. Twenty-four needles 52,54 may be provided and/or other number and not all need necessarily provide yarn for all operations. When the needles punch through the material 46, which is preferably a layer of backing or a layer of loops in tufted carpet, they then may possibly engage hook 98 and/or knife 100 in foot(s) 104 as could be servo controlled by motor 102 with computer 34 or otherwise to engage or disengage a particular loop for various embodiments. The servo motor 102 and/or carriage or foot 104 may be located relative to head 16 such as with sensors 106,108 connected to head 16 which could cooperate with sensors 110,112 and/or others connected to the carriage or foot 104 to assist in maintaining positioning of the foot 104 relative to the head 16 to maintain desired locations relative to one another possibly using computer 34. Separate servo motor(s) may control movement of foot 104, or movement of foot 104 may be coupled to the operation of servo 32 such as is shown in FIG. 1 and others as would be understood by those of ordinary skill in the art to reduce or eliminate alignment issues.

Figure 8:
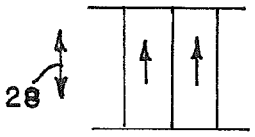
FIG. 8 is a top schematic view of a presently preferred path of the head in operation.
Figure 9:
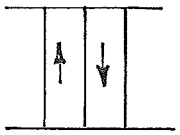
FIG. 9 is a top schematic view of a first alternatively preferred path of heads in operation.
Figure 10:
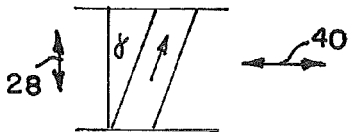
FIG. 10 is a top schematic view of a second alternatively preferred path of operation.

FIGS. 8-10 show that the rows of needles may be tufted in the lateral direction 28 which is perpendicular to the direction of feed 40. The needles could also travel off offset angle $\alpha$ relative to the lateral direction (such as an acute angle up to about 15, 30 or even about 45 degrees or more for some embodiments). It may be that the computer 34 instructs the tufting in a single lateral direction as shown in FIG. 8 and/or in both lateral directions as shown in FIG. 9 for various embodiments. As shown in FIGS. 8-9, the needles are in a row, line, along a normal direction of tuft 40 which is not believed to have ever been performed before for at least some embodiments particularly when the carpet material 46 is pretufted carpet.

Figure 11:
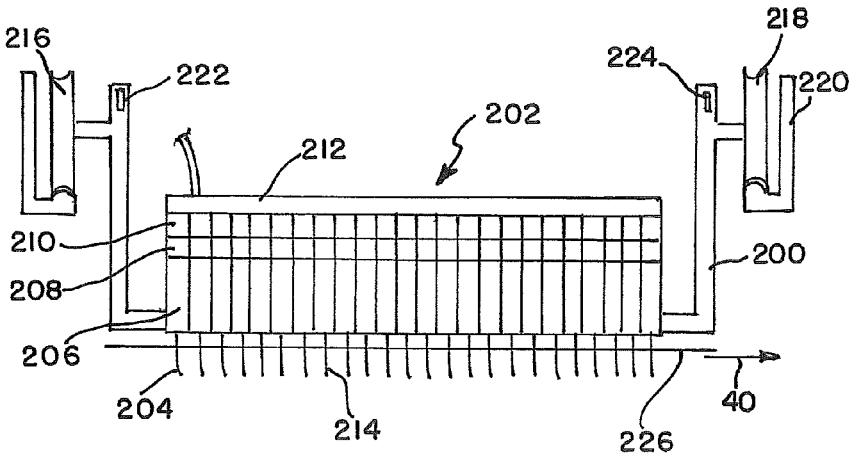
FIG. 11 is a side plan view of an alternatively preferred head and carriage arrangement as moves relative to a frame such as with a chain drive or otherwise.

FIG. 11 shows a carriage 200 having a head 202 with twenty four needles systems 204 which have an inserter 206 as well as a yarn feeder 208, and motor 210 that connects to a manifold 212 for receiving air. These and/or other systems can be used with other embodiments. Other numbers of needles 214 may be used with other embodiments. The needles are illustrated linearly arranged relative to the direction of feed 40. Rollers 216,218 allow the carriage 200 to move laterally (parallel for most embodiments) relative to the direction of feed, i.e., into and out of the paper as illustrated. Frame 220 supports the rollers 216,218 and a chain drive 222,224 is illustrated although other driving systems for moving the carriage 200 relative to the frame 220 can be used with other embodiments. Yarn feeders 208 may operate similarly or dissimilarly to those of mending guns that allow for at least two different pile height (i.e., more yarn is fed on one setting than another). With computer controlled motor 210, it may be that an unlimited number of pile heights in carpet material 226 may be controlled on the fly.

Figure 14:
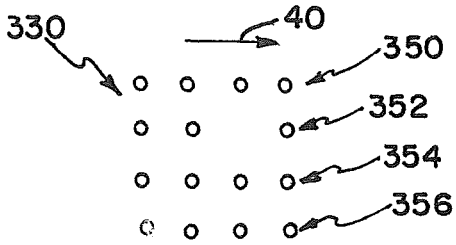
FIG. 14 shows a bottom plan view of an array of needles for an alternatively preferred embodiment as could be provided on a carriage.

FIG. 14 shows yet another embodiment in which multiple colors could be introduced as loops 304,306,312,314. Specifically, an array of needles 330 is provided (4×4) illustrated, possibly providing four or more colors, other arrays of needles 330 may have different arrangements 1×24, 2×2, 2×12, 3×5, or any other arrangement depending on the criteria of the device. Cutter 332 in guns 300 may be useful to cut yarn 334 after making a stitch to assist in transition of colors of loops 304,306,312, 314. Motor 336 may be useful to switch between high and low setting 338,340 for at least some embodiments so that yarn feeder 342 provides more yarn for higher loop 304 and less yarn for lower loop 306. Other mechanisms may operate differently as would be understood by those of ordinary skill in the art. First row 350 might have first color, second row 352 might have second color, third row 354 might have third color and fourth row 356 might have fourth color, etc. All embodiments do not necessarily provide cutters 332, but some may.

Figure 13:
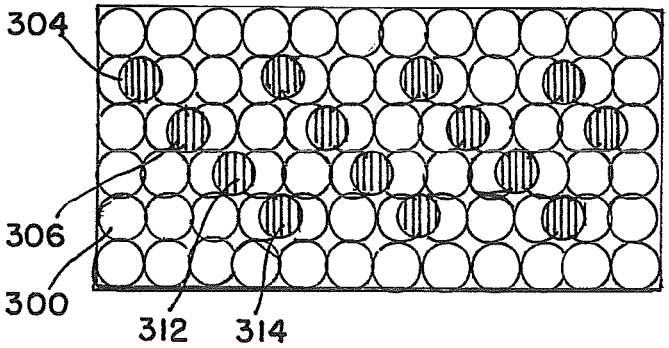
FIG. 13 is a top plan view of a carpet segment having been overtufted in accordance with a presently preferred embodiment of the invention.

As may be understood with reference to FIG. 13, where the overtufted yarn is provided as part of a design, the tufts per inch or other area is higher than in area with no overtufting having a similar pre-tufted design. Also, unlike prior art methodology known to the applicant, purposely overtufting through pre-tufted carpet to provide a design is believed to be novel.

Figure 15:
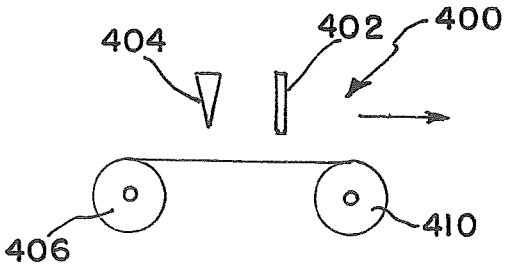
FIG. 15 shows a schematic representation of a tip shearing device after overtufting carpet in accordance with the invention which may be used with some embodiments.

FIG. 15 shows a machine 400 tip shearing the carpet after adding in the design as shown and described herein. By having an overtufted design, particularly for at least some embodiments, one that has used multiple yarns per needle in the process described herein to add in a design into a pre-existing array such as 10×10, etc., and then tip shearing the loops to a pre-determined height, such as at the height of the carpet, or otherwise, rather unique and desirable design effects can be created giving rise to custom carpet looks, even when done with commercial high speed equipment.

Tip shearing can take place using various equipment known in the art. Input roll 406 is directing product to output roll 410 in direction 408. One or more shears 402,404 may cut at various heights and positions as desired depending on the product to be made. For instance the pattern of FIG. 13 could be tip sheared to a uniform height for yet another appearance. Alternatively tip shearing rows laterally and/or in the direction of tuft may be desirable for some designs and embodiments.

Figure 16:
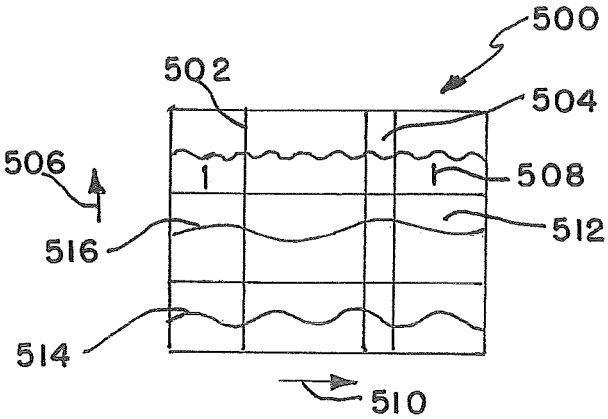
FIG. 16 is a top plan view of a carpet segment having been overtufted in accordance with a presently preferred embodiment of the invention.

FIG. 16 shows yet another set of pattern possibilities, preferably those even given rise to a hand tufted carpet look. The carpet 500 has stripes 502,504 which could be tufted with the tufting machine as is known in the art when producing the tufted carpet 500. Then the tufted carpet 500 could be overtufted with the technology shown and described herein, possibly together with multiple yarns directed through one more needles which could give still further effects. Then tip shearing could also be employed as described above or otherwise. Not only can overtufting occur in the direction of tuft 506, such as by adding in element 508, etc., overtufting can also be imparted in a lateral direction 510 (perpendicular to the direction of tuft 506) such as shown by stripe 512, etc. Furthermore design style elements can be imparted such as diagonal lines 514 or curves 516,518, or even discontinuities, etc. With a controller detailed designs can be overtufted using the technology described herein. Multiple yarns through a single needle can provide still other effects depending upon the rate of twist, tension, etc., applied to the various yarns at various times.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An overtufting machine comprising:
a) a pre-tufted input roll of carpet feeding to an output roll in a direction of feed;
b) at least one rail directed at least somewhat laterally relative the direction of feed;
c) at least one carriage supporting at least one head with at least one needle operably coupled to the rail and movable at least laterally relative to the direction of feed along the at least one rail, said at least one needle configured to stitch intermediate pre-tufted loops of the tufted carpet with at least a portion of a design to provide a higher stitch count density in an area of the at least a portion of the design than in areas not having the at least a portion of the design.

2. The overtufting machine of claim 1 wherein the rolls are supported to be relatively laterally shifted relative to the at least one needle.

3. The overtufting machine of claim 1 further comprising a driver, said driver automatedly moving at least one of the at least one carriage and at least one needle to a desired position relative to the at least one rail.

4. The overtufting machine of claim 1 wherein the at least one carriage further comprises at least first and second carriages supported by the at least on rail.

5. The overtufting machine of claim 1 further comprising a computer, said computer directing movement of the head relative to the roll of carpet.

6. The overtufting machine of claim 5 wherein the computer controls movement of the carpet in the direction of feed.

7. The overtufting machine of claim 5 wherein the computer elevationally adjusts a level of tuft by the at least one needle.

8. The overtufting machine of claim 5 wherein the computer controls movement in a reverse direction of feed of the carpet.

9. The overtufting machine of claim 5 wherein the computer controls movement of the at least one head relative to the at least one carriage.

10. The overtufting machine of claim 1 wherein the at least one needle is configured to tuft selectively between at least high and low loops through the carpet.

11. The overtufting machine of claim 1 further comprising a foot, said foot moveable in a corresponding manner with the head, whereby the foot is located opposite the carpet from the head.

12. The overtufting machine of claim 11 wherein the foot provides at least one hook.

13. The overtufting machine of claim 12 wherein the foot provides at least one knife which coordinates cutting of yarn with the at least one hook.

14. The overtufting machine of claim 11 wherein the foot is operably coupled to a rail parallel to the at least one rail supporting the at least one carriage.

15. The overtufting machine of claim 1 wherein the at least one needle further comprises an array of needles moveable along the lateral direction.

16. The overtufting machine of claim 1 wherein the at least one rail further comprises first and second parallel rails with the carriage supported intermediate thereto.

17. The overtufting machine of claim 1 wherein the at least one carriage further comprises at least first and second independently controllable carriages movable along the at least one rail.

18. The overtufting machine of claim 1 wherein the at least one rail is linearly disposed and angled between 45 and 90 degrees relative to the direction of feed.

19. The overtufting machine of claim 1 further comprising a tufting station intermediate the input and output roll spaced upstream from the at least one rail whereby the tufting station tufts the carpet.

20. An overtufting machine comprising:
a) an input roll feeding to an output roll in a direction of feed, said output roll having tufted carpet thereon;
b) at least one rail directed at least somewhat laterally relative the direction of feed;

c) a first station tufting a design to provide the tufted carpet;

d) downstream in the direction of feed and spaced from the first station, at least one carriage supporting at least one head with at least one needle operably coupled to the rail and movable at least laterally relative to the direction of feed along the at least one rail, said at least one needle configured to stitch intermediate pre-tufted loops of the tufted carpet with at least a portion of a design to provide a higher stitch count density in an area of the at least a portion of the design than in areas not having the at least a portion of the design.

* * * * *